US009072320B2

(12) United States Patent
Coatney et al.

(10) Patent No.: US 9,072,320 B2
(45) Date of Patent: Jul. 7, 2015

(54) MULTI-COMPARTMENT PACKAGE AND RELATED METHOD, BLANK AND ASSEMBLY

(75) Inventors: Ted R. Coatney, Clemmons, NC (US); Heather Potter, Lexington, KY (US); Matthew Edward Scharf, Pfafftown, NC (US); Michael Howard Hill, Greensboro, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 406 days.

(21) Appl. No.: 13/524,218

(22) Filed: Jun. 15, 2012

(65) Prior Publication Data

US 2013/0334293 A1 Dec. 19, 2013

(51) Int. Cl.

| | |
|---|---|
| ***B65D 5/48*** | (2006.01) |
| ***A24F 15/18*** | (2006.01) |
| ***B65D 85/10*** | (2006.01) |

(52) U.S. Cl.

CPC ..... *A24F 15/18* (2013.01); *B65D 85/1036* (2013.01); *B65D 5/48014* (2013.01); *B65D 85/10* (2013.01)

(58) Field of Classification Search

CPC .... A24F 15/18; B65D 5/48014; B65D 85/10; B65D 85/1036

USPC ..... 229/120.03, 120.11, 120.18, 120.21; 206/256, 268, 271, 273, 275

See application file for complete search history.

(56) References Cited

U.S. PATENT DOCUMENTS

| | | | | |
|---|---|---|---|---|
| 409,029 | A * | 8/1889 | Elliot | 229/120.18 |
| 1,556,514 | A * | 10/1925 | Feldman | 229/120.18 |
| 2,015,278 | A * | 9/1935 | Meyer | 229/120.18 |
| 3,007,623 | A | 11/1961 | Clemens | |
| 3,148,768 | A | 9/1964 | Gatto | |
| 3,226,010 | A | 12/1965 | Rogers, Jr. | |
| 3,695,422 | A | 10/1972 | Tripodi | |
| 4,294,353 | A | 10/1981 | Focke et al. | |
| 4,651,918 | A * | 3/1987 | Moore et al. | 229/120.18 |
| 4,784,261 | A | 11/1988 | Kutchin | |
| 5,139,140 | A | 8/1992 | Burrows et al. | |
| 5,214,901 | A | 6/1993 | Milliner | |
| 5,513,752 | A * | 5/1996 | Gottlieb | 229/120.18 |
| 5,682,986 | A | 11/1997 | Cobler | |
| 5,918,734 | A * | 7/1999 | Devens et al. | 206/87 |
| 5,938,018 | A | 8/1999 | Keaveney et al. | |
| 6,612,429 | B2 | 9/2003 | Dennen | |
| 6,644,540 | B2 * | 11/2003 | Jamitzky et al. | 229/120.11 |
| 6,726,006 | B1 | 4/2004 | Funderburk et al. | |
| 6,837,369 | B2 | 1/2005 | Amos | |
| 6,889,827 | B2 | 5/2005 | Stringfield | |
| 6,932,219 | B2 | 8/2005 | Chacko et al. | |
| D509,623 | S | 9/2005 | Mitten et al. | |

(Continued)

*Primary Examiner* — Gary Elkins

(74) *Attorney, Agent, or Firm* — Womble Carlyle Sandridge & Rice, LLP

(57) ABSTRACT

A blank configured to form a multi-compartment package is provided. The blank may include a rear panel, a rear side panel connected to the rear panel, a first side panel connected to the rear panel, a front panel connected to the first side panel, a second side panel connected to the front panel, and a dividing panel connected to the second side panel. The blank may be formed into a multi-compartment package including front and rear compartments in accordance with a related method. A first item may be inserted in the front compartment and a second item may be inserted in the rear compartment to form a related assembly. A width of the first side panel may be greater than a width of the rear side panel.

27 Claims, 13 Drawing Sheets

(56) References Cited

U.S. PATENT DOCUMENTS

| | | | | |
|---|---|---|---|---|
| 6,971,511 | B2 * | 12/2005 | Holmon | 229/120.18 |
| D523,171 | S | 6/2006 | Mitten et al. | |
| D523,990 | S | 6/2006 | Mitten et al. | |
| 7,100,763 | B2 | 9/2006 | Draghetti | |
| 7,100,764 | B2 | 9/2006 | Focke | |
| 7,617,930 | B2 | 11/2009 | Jones et al. | |
| 8,006,835 | B2 | 8/2011 | Moore et al. | |
| 8,020,697 | B2 | 9/2011 | Chatelain et al. | |
| 8,739,969 | B2 * | 6/2014 | Schuld | 206/268 |
| 2002/0117409 | A1 * | 8/2002 | Okin et al. | 229/120.18 |
| 2005/0023158 | A1 | 2/2005 | Mitten et al. | |
| 2005/0150786 | A1 | 7/2005 | Mitten et al. | |
| 2005/0155878 | A1 | 7/2005 | Pham | |
| 2006/0091026 | A1 | 5/2006 | Mitten et al. | |
| 2007/0199982 | A1 * | 8/2007 | Lo Duca | 229/120.11 |
| 2009/0250361 | A1 | 10/2009 | Moore et al. | |
| 2011/0162984 | A1 | 7/2011 | Bellamah et al. | |
| 2013/0233743 | A1 * | 9/2013 | Hillard | 206/273 |

* cited by examiner

MULTI-COMPARTMENT PACKAGE AND RELATED METHOD, BLANK AND ASSEMBLY

FIELD OF THE DISCLOSURE

The present invention relates to packaging that may be employed to hold multiple tobacco products, such as packaged smoking articles and packaged smokeless tobacco products.

BACKGROUND

Popular smoking articles, such as cigarettes, conventionally have been sold in packages. Typically, each full package contains about 20 cigarettes. Cigarettes have been packaged in containers known as so-called "soft packs." See, for example, U.S. Pat. No. 3,695,422 to Tripodi; U.S. Pat. No. 4,717,017 to Sprinkel, Jr., et al.; and U.S. Pat. No. 5,333,729 to Wolfe, all of which are incorporated herein by reference. Cigarettes also have been packaged in containers known as so-called "hard packs" or "crush proof boxes." See, for example, U.S. Pat. No. 3,874,581 to Fox et al.; U.S. Pat. No. 3,944,066 to Niepmann; and U.S. Pat. No. 4,852,734 to Allen et al., all of which are incorporated herein by reference.

Tobacco products typically are provided in individual packages. In certain circumstances, however, two or more packages of tobacco products can be combined, for example, in paperboard sleeves, such as for sales, marketing, and promotional purposes. See, for example, U.S. Pat. No. 3,007,623 to Clemens; U.S. Pat. No. 3,148,768 to Gatto; U.S. Pat. No. 3,226,010 to Rogers, Jr.; U.S. Pat. No. 4,294,353 to Focke et al.; U.S. Pat. No. 4,784,261 to Kutchin; U.S. Pat. No. 5,139,140 to Burrows et al.; U.S. Pat. No. 5,214,901 to Milliner; U.S. Pat. No. 5,682,986 to Cobler; U.S. Pat. No. 5,938,018 to Keaveney; U.S. Pat. No. 6,612,429 to Dennen; U.S. Pat. No. 6,837,369 to Amos; U.S. Pat. No. 6,889,827 to Stringfield; U.S. Pat. No. 6,932,219 to Chacko et al.; U.S. Pat. No. 7,100,763 to Draghetti; U.S. Pat. No. 7,100,764 to Focke; U.S. Pat. No. 8,006,835 to Moore et al.; U.S. Pat. No. 8,020,697 to Chatelain et al.; U.S. Pat. No. D509,623 to Mitten; U.S. Pat. No. D523,171 to Mitten et al.; U.S. Pat. No. D523,990 to Mitten et al.; and U.S. Pat. App. Pub. Nos. 2005/0023158 to Mitten et al.; 2005/0150786 to Mitten et al.; 2005/0155878 to Pham; and 2006/0091026 to Mitten et al., each of which is incorporated herein by reference. See also, for example, the types of packaging configurations used for cigarettes sold in Japan under the tradename "Duo Virginia Slims."

It would be desirable to provide a packaging configuration that allows for the combination of packages of two or more items, particularly packages of two or more different tobacco items, such as a package of cigarettes and a package of a smokeless tobacco product.

SUMMARY OF THE DISCLOSURE

In one embodiment a blank configured to form a multi-compartment package is provided. The blank may comprise a rear panel, a rear side panel connected to the rear panel, a first side panel connected to the rear panel, a front panel connected to the first side panel, a second side panel connected to the front panel, and a dividing panel connected to the second side panel. A width of the first side panel may be greater than a width of the rear side panel.

In an additional embodiment a multi-compartment package is provided. The multi-compartment package may comprise a plurality of panels, a rear compartment defined by four of the panels, and a front compartment defined by four of the panels. The rear compartment and the front compartment may be arranged in a back-to-back configuration, and two of the panels of the rear compartment may be common to two of the panels of the front compartment. In one embodiment the panels may include a rear panel, a rear side panel connected to the rear panel, a first end panel connected to the rear side panel, a first side panel connected to the rear panel, a front panel connected to the first side panel, a second side panel connected to the front panel, a dividing panel connected to the second side panel, and a second end panel connected to the dividing panel. The first end panel may be coupled to the dividing panel to define the rear compartment between the dividing panel, the rear side panel, the first side panel, and the rear panel. The second end panel may be coupled to the first side panel to define the front compartment between the dividing panel, the first side panel, the second side panel, and the front panel.

In another embodiment an assembly is provided. The assembly may comprise the above-described multi-compartment package. A first item (e.g., a package of a first tobacco product) may be received in the front compartment, and a second item (e.g., a package of a second tobacco product) may be received in the rear compartment.

In some embodiments of the blank, the multi-compartment package, and/or the assembly, a height of the front panel may be less than a height of the first side panel and the second side panel. The first side panel may define a front portion that is connected to the front panel and a rear portion that is connected to the rear panel, and the front portion may define a height that is less than the rear portion. A first end panel may be connected to the rear side panel. A second end panel may be connected to the dividing panel. A tab may be connected to the dividing panel and a tab may be connected to the rear panel. The tab connected to the dividing panel and the tab connected to the rear panel may be positioned at opposing sides. An aperture may be defined in the second side panel. A width of the first side panel may be greater than a width of the second side panel. The width of the first side panel may be substantially equal to the width of the second side panel and the width of the rear side panel combined.

With further regard to the assembly, in some embodiments the first item may comprise a cigarette pack. A height of the front panel may be less than a height of the first side panel and the second side panel, and a logo on the cigarette pack may be positioned above a top of the front panel. An aperture may be defined in the second side panel, and an identifier on the cigarette pack may be aligned with the aperture in the second side panel. The second item may comprise a smokeless tobacco package. The multi-compartment package may further comprise a tab connected to the dividing panel and a tab connected to the rear panel, and the tab connected to the dividing panel and the tab connected to the rear panel may be positioned at opposing sides. Further, the tab connected to the dividing panel may be folded toward the rear panel and the tab connected to the rear panel may be folded toward the dividing panel to at least partially retain the smokeless tobacco package in the rear compartment.

A method for forming a multi-compartment package is provided. The method may comprise providing a blank, which may comprise the above-described blank. The method may further include coupling the first end panel to the dividing panel to define a rear compartment between the dividing panel, the rear side panel, the first side panel, and the rear panel. Additionally, the method may include coupling the second end panel to the first side panel to define a front compartment between the dividing panel, the first side panel, the second side panel, and the front panel.

In some embodiments the method may further comprise inserting a first item into the front compartment, and inserting a second item into the rear compartment. The blank may further comprise a tab connected to the dividing panel and a tab connected to the rear panel, and the tab connected to the dividing panel and the tab connected to the rear panel may be positioned at opposing sides. The method may further comprise folding the tab connected to the dividing panel toward the rear panel and folding the tab connected to the rear panel toward the dividing panel to at least partially retain the second item in the rear compartment.

Other aspects and advantages of the present disclosure will become apparent from the following.

BRIEF DESCRIPTION OF THE DRAWINGS

In order to assist the understanding of embodiments of the disclosure, reference will now be made to the appended drawings, which are not necessarily drawn to scale. The drawings are exemplary only, and should not be construed as limiting the disclosure.

DETAILED DESCRIPTION OF THE PREFERRED EMBODIMENTS

The present disclosure now will be described more fully hereinafter with reference to the accompanying drawings. The disclosure may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural references unless the context clearly dictates otherwise.

As described herein, embodiments of the disclosure relate to blanks configured to form multi-compartment packages and related assemblies and methods. As described in detail below, embodiments may be directed to use of the compartments to store items, such as for sales, marketing, and promotional purposes. For example, an assembly for a combination package may include a front compartment containing a package of cigarettes, and a rear compartment containing a package of a smokeless tobacco product. More generally, the assembly may be employed to distribute two packages of products, which may be different products and/or products provided in different amounts. For example, a typical commercial content of a first product can be provided in a package in the front compartment, and a relatively smaller content of a second product can be provided in a package in the rear compartment. To this end, the front compartment may have a volume that is greater than the volume of the rear compartment—e.g., about 10% greater or more, about 25% greater or more, or about 50% greater or more.

Figure 1:
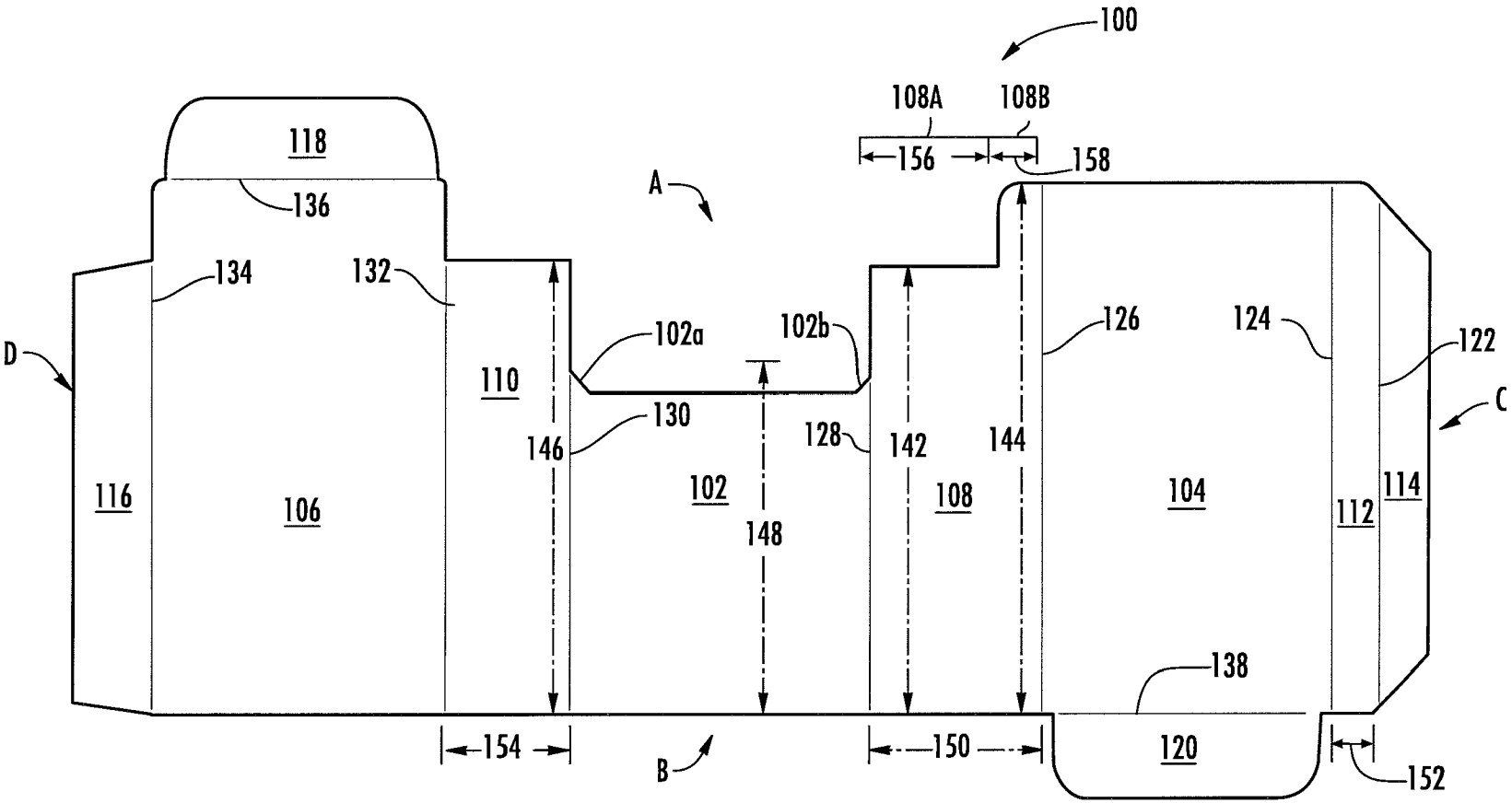
FIG. 1 is a plan view of a blank configured to form a multi-compartment package according to an example embodiment.

In this regard, FIG. 1 illustrates an example embodiment of a blank 100 configured to form a multi-compartment package. The blank 100 may comprise one or more layers of one or more materials suitable to provide structure to the blank such that it may form a package as disclosed below. For example, the blank 100 may comprise paper, paperboard, cardboard, thermoplastic, or any other suitable material. In some embodiments the material defining the blank 100 may be laminated or coated with wax or other material. Further, the blank 100 may be imprinted via any of various known methods to provide the blank with, for example, an ornamental design, and/or identifying information. Useful exemplary materials include paper board of a suitable type and stock, such as 10 to 14 point SBS paper board (i.e., solid bleached sulfate paper), which may include a coating on one or both sides, such as a clay coating. Comparable board containing post consumer recycled content likewise may be used. Suitable paper stock can be obtained commercially, such as from International Paper or MeadWestvaco.

The blank 100 may define various embodiments of sizes and shapes. Accordingly, it should be understood that the embodiment of the blank 100 illustrated in FIG. 1 is provided for example purposes only. In this regard, the blank 100 may include a first panel 102 (e.g., a front panel), a second panel 104 (e.g., a rear panel), and a dividing panel 106. A first side panel 108 and a second side panel 110 may be connected to the front panel 102. Further, a third side panel 112 (e.g., a rear side panel) may be connected to the rear panel 104. Additionally, a first end panel 114 may be connected to the rear side panel 112 and a second end panel 116 may be connected to the dividing panel 106.

In some embodiments the blank 100 may include one or more tabs. For example, in the illustrated embodiment the blank 100 includes a tab 118 connected to the dividing panel 106 and a tab 120 connected to the rear panel 104. As illustrated, the tabs 118, 120 may be positioned at opposing sides A, B of the blank 100. For example, the tab 118 may be connected to a first side A of the blank 100 at the dividing panel 106. The first side A of the blank 100 may be configured to form the top of a package. The tab 120 may be connected to an opposing second side B of the blank 100 at the rear panel 104. The second side B of the blank 100 may be configured to form the bottom of a package. However, in alternate embodiments the tab connected to the dividing panel may be connected to the second side, and the tab connected to the front panel may be connected to the first side. In another embodiment, two tabs may be connected to the dividing panel at the opposing sides A, B, or two tabs may be connected to the rear panel at the opposing sides A, B. As will be described below, positioning the tabs at the opposing sides of the blank may allow the tabs to retain an item within a compartment formed by the blank. The tabs 118, 120 may define the same, or different, shapes and dimensions.

Each of the panels may be separated by a line of demarcation, which is generally referred to herein as a fold line. In this regard, the blank 100 is configured to fold along a plurality of fold lines to form a package, as will be described below. In some embodiments one or more of the fold lines may define one or more slits, perforations, or other features configured to facilitate folding of the blank 100 at the fold lines. These features may extend partially or completely through the material defining the blank 100.

In this regard, the blank 100 may include a fold line 122 between the first end panel 114 and the rear side panel 112, a fold line 124 between the rear side panel 112 and the rear panel 104, a fold line 126 between the rear panel 104 and the first side panel 108, a fold line 128 between the first side panel 108 and the front panel 102, a fold line 130 between the front panel 102 and the second side panel 110, a fold line 132 between the second side panel 110 and the dividing panel 106, and a fold line 134 between the dividing panel 106 and the second end panel 116. Further, the blank 100 may include a fold line 136 between the dividing panel 106 and the tab 118 connected thereto, and a fold line 138 between the rear panel 104 and the tab 120 connected thereto. The fold line 136 between the tab 118 and the dividing panel 106 and the fold line 138 between the tab 120 and the rear panel 104 may be substantially perpendicular to the fold lines 122-134 between the above-described panels 102-116. Although not expressly shown, one or both of the tab 118 and the tab 120 may include a further fold line positioned between the fold line 136 or 138, respectively, and the free end of the tab such that, in the folded state, a portion of the tab(s) may be tucked within the folded assembly so as to facilitate closure of the formed, rear compartment.

Additionally, in some embodiments corner features may be provided at the intersections between panels. For example, the front panel 102 includes corner features 102*a*, 102*b*. The corner features, which may be curved (e.g., rounded) or angular (e.g., triangular) in some embodiments, may be configured to reduce stress at the fold lines between panels having differing heights.

In some embodiments, an aperture may be defined in one of the panels 102-116. For instance, in one example embodiment an aperture may be defined in the second side panel 110 (see, e.g., aperture 140 in FIGS. 12 and 13). In some embodiments the aperture may be covered by a transparent or translucent material. As will be discussed below, the aperture may be configured to align with an identifier on an item positioned in a compartment formed by the blank 100.

With respect to additional features of the blank 100, the various portions of the blank may include heights (e.g., in the up and down directions between the first side A and the second side B in FIG. 1) and widths (e.g., in the left and right directions between a first end C and a second end D in FIG. 1) that are configured to define specific dimensions relative to one another and/or relative to the items that a package formed from the blank may hold. For example, the first side panel 108 may define a first portion 108A (e.g., a front portion) that is connected to the front panel 102 and a second portion 108B (e.g., a rear portion) that is connected to the rear panel 104, and the front portion may have a height 142 that differs from a height 144 of the rear portion. In one embodiment, the height 142 of the front portion 108A of the first side panel 108 may be less than the height 144 of the rear portion 108B of the first side panel.

By way of further example, the height 142 of the front portion 108A of the first side panel 108 may be substantially equal to a height 146 of the second side panel 110 in some embodiments. Further, the height 144 of the rear portion 108B of the first side panel 108 may be substantially equal to a height of the rear panel 104, a height of the rear side panel 112, and/or a height of the dividing panel 106 in some embodiments. Additionally, the height 142 of the front portion 108A of the first side panel 108 may be substantially equal to a height of the second side panel 110 in some embodiments. Also, a height 148 of the front panel 102 (inclusive or exclusive of the corner features 102*a*, 102*b*) may be less than a height of the first side panel 108 (e.g., less than the height 142 of the front portion 108A and/or less than the height 144 of the rear portion 108B). The height 148 of the front panel 102 may additionally or alternatively be less than the height 146 of the second side panel 110.

With respect to widths of the panels, a width 150 of the first side panel 108 may be greater than a width 152 of the rear side panel 112. Also, the width 150 of the first side panel 108 may be greater than a width 154 of the second side panel 110. Further, the front portion 108A of the first side panel 108 may have a width 156 that is greater than a width 158 of the rear portion of the first side panel. In one embodiment the width 150 of the first side panel 108 (i.e., the overall width of the first side panel) may be substantially equal to the width 154 of the second side panel 110 and the width 152 of the rear side panel 112 combined (i.e., substantially equal to a combined width (154+152) of the second side panel 110 and the rear side panel 112). As noted above, the blank 100 may be configured to form a multi-compartment package.

Figure 2:
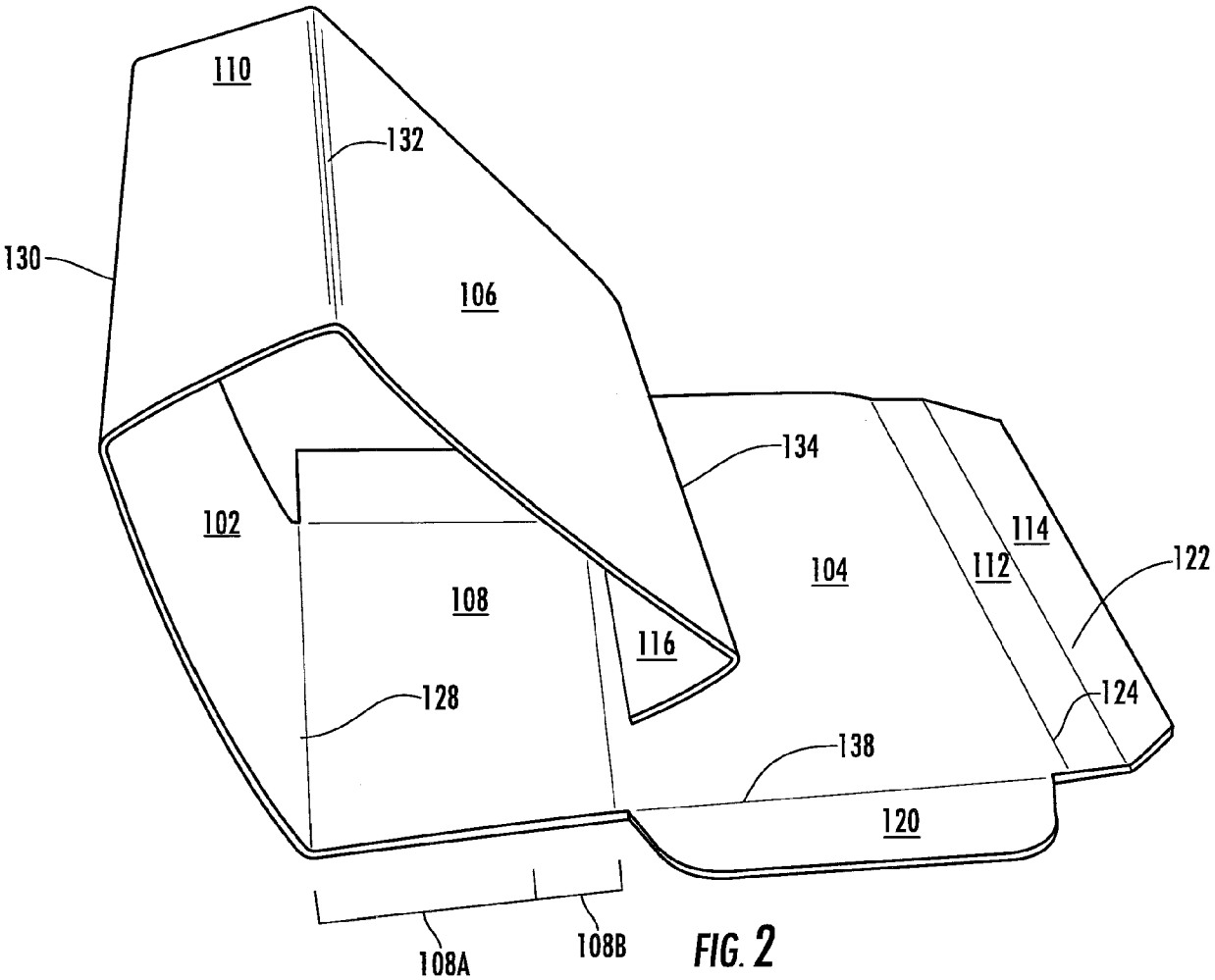
FIG. 2 is a perspective view of example folding operations conducted in a method for forming a multi-compartment package from the blank of FIG. 1.
Figure 3:
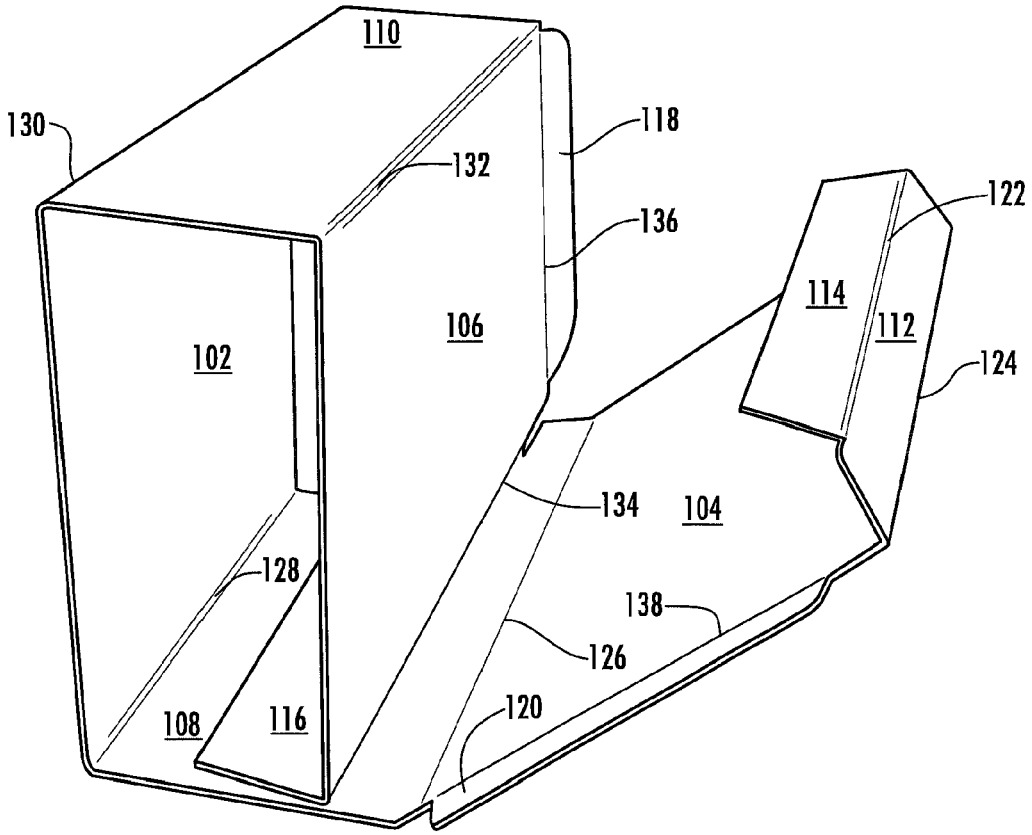
FIG. 3 is a perspective view of additional example folding operations conducted in the method for forming a multi-compartment package from the blank of FIG. 1.

In this regard, FIGS. 2 and 3 illustrate operations that may be performed in a method for forming a multi-compartment package from the blank 100. Although the blank 100 is shown and described as being formed into a package in a specified order of operations, it should be understood that these operations may be performed in other sequences and in other manners in other embodiments.

FIG. 2 illustrates example operations that may be performed in a method for forming a package from the blank 100. In particular, FIG. 2 illustrates the blank 100 when operations performed in the formation of a front compartment have been partially completed. In this regard, the operations may include folding the blank 100 at: the fold line 128 between the first side panel 108 and the front panel 102; the fold line 130 between the front panel 102 and the second side panel 110; the fold line 132 between the second side panel 110 and the dividing panel 106; and the fold line 134 between the dividing panel 106 and the second end panel 116. Each of these folds may define ninety degree angles such that adjacent panels are perpendicular to one another. To complete the front compartment, the operations may further include coupling the second end panel 116 to the first side panel 108. In particular, the second end panel 116 may be glued, heat welded, or otherwise coupled to the first side panel 108 such that the dividing panel 106 aligns with a point along the width of the first side panel at which the front portion 108A of the first side panel 108 at the first height 142 joins the rear portion 108B of the first side panel 142 at the differing second height 144. To this end, one or more portions of the blank may be provided with a coupling material thereon—e.g., a glue or other adherent material, which may be protected, such as with a removable release layer. Exemplary types of adhesives that may be used include vinyl acetates, hot melts, and dextrins, including adhesives such as those available from Henkel AG & Co.

FIG. 3 illustrates the blank 100 in a partially assembled position. In particular, FIG. 3 illustrates the blank 100 after the second end panel 116 has been coupled to the first side panel 108 (specifically, coupled to the front portion 108A of the first side panel) and various folds have been completed, as described above with respect to FIG. 2. As further illustrated in FIG. 3, additional operations performed in the method for forming the package may include folding the blank 100 at: the fold line 126 between the first side panel 108 and the rear panel 104; the fold line 124 between the rear panel 104 and the rear side panel 112; and the fold line 122 between the rear side panel 112 and the first end panel 114. Each of these folds may define ninety degree angles in some embodiments such that adjacent panels are perpendicular to one another. To complete the rear compartment, the method may further comprise coupling the first end panel 114 to the dividing panel 106, for example, by gluing, heat welding, or otherwise coupling the two panels together. Note that by coupling the first end panel 114 to the dividing panel 106, instead of the second side panel 110, issues may be avoided with respect to partially or fully blocking an aperture in the second side panel (see, e.g., aperture 140 in FIGS. 12 and 13). Moreover, such coupling avoids the necessity of overlapping panels around the circumference of the completely folded blank, which can facilitate ease of stocking of multiple packages, such as in a side-by-side configuration, and the absence of overlapping panels also can provide improved aesthetics. Further, this internal folding arrangement reduces the number of edges on the outer surface of a package produced from the blank, such that it may be less likely for an edge of the package to snag and come undone.

Figure 4:
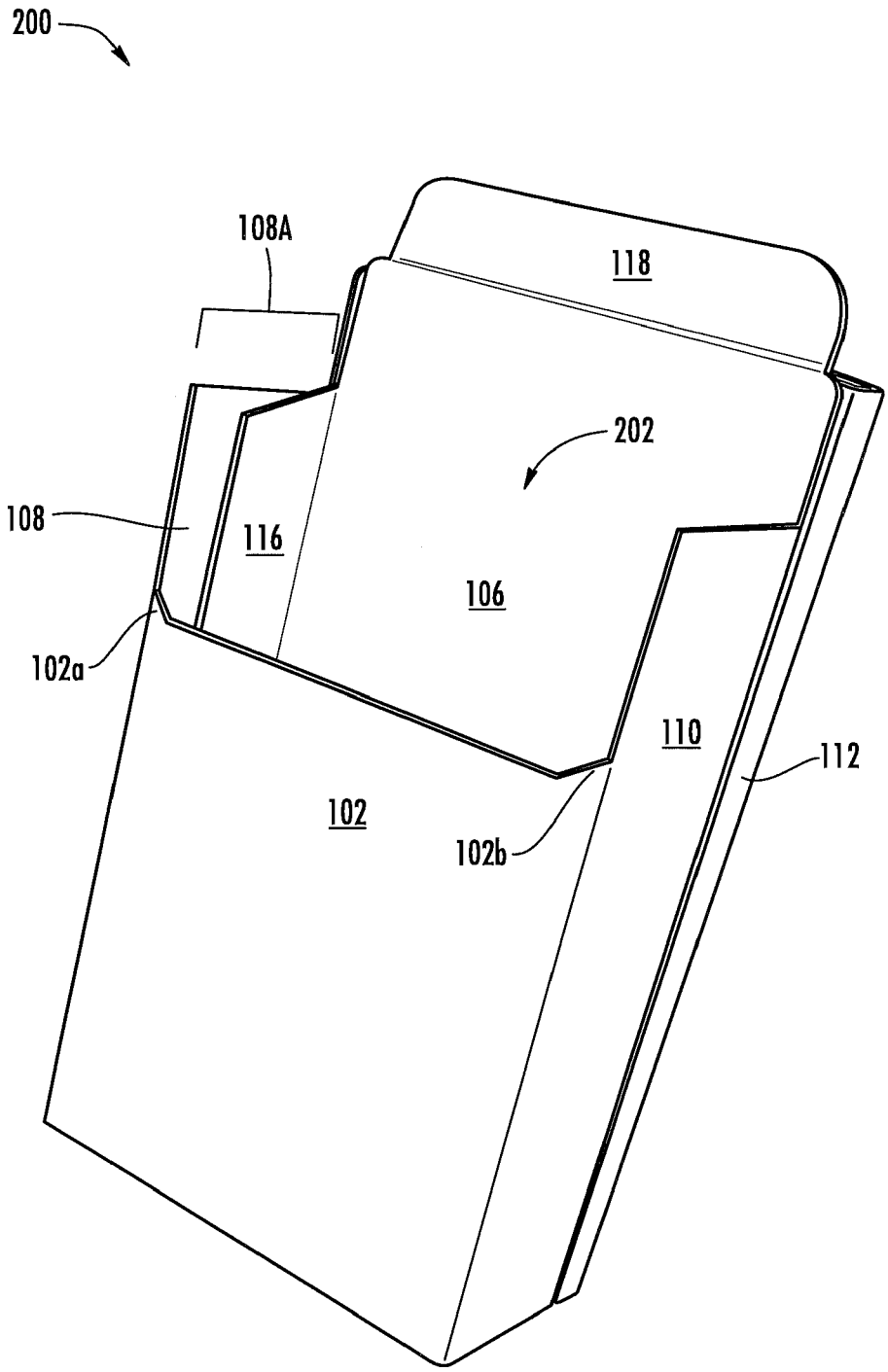
FIG. 4 is a front perspective view of a multi-compartment package formed from the blank of FIG. 1 according to an example embodiment.
Figure 5:
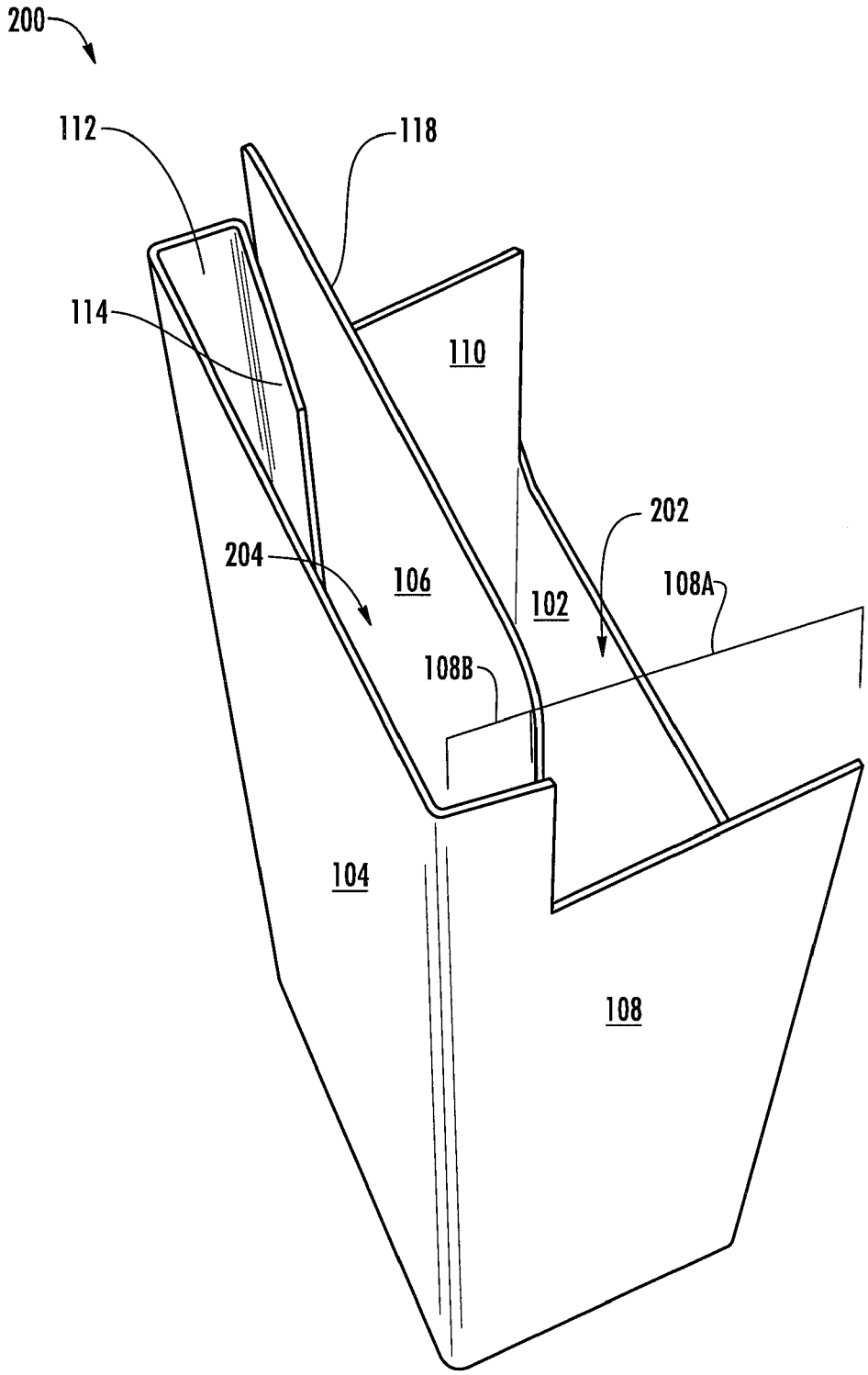
FIG. 5 is a rear perspective view of the multi-compartment package of FIG. 4.

FIGS. 4-11 illustrate a package 200 that may be formed from the blank 100 in accordance with the method described above. FIG. 4 illustrates a front perspective view of the package 200. As illustrated, the package 200 may define a first compartment 202 (e.g., a front compartment). The front compartment 202 may be formed in accordance with the operations discussed above with respect to FIG. 2. In particular, the second end panel 116 may be coupled to the first side panel 108 (specifically, coupled to the front portion 108A of the first side panel) to define the front compartment 202 between the dividing panel 106, the first side panel 108 (specifically, the front portion 108A of the first side panel), the second side panel 110, and the front panel 102. Further, as illustrated in the rear perspective view of FIG. 5, the package 200 may define a second compartment 204 (e.g., a rear compartment). The rear compartment 204 may be formed in accordance with the operations discussed above with respect to FIG. 3. In particular, the first end panel 114 may be coupled to the dividing panel 106 to define the rear compartment 204 between the dividing panel 106, the rear side panel 112, the first side panel 108 (specifically, the rear portion 108B of the first side panel), and the rear panel 104.

Accordingly, both the front compartment 202 and the rear compartment 204 may be partially defined by the first side panel 108. In this regard, the front portion 108A of the first side panel 108 may define a wall around the front compartment 202, and the rear portion 108B of the first side panel 108 may define a wall around the rear compartment 204. Further, both the front compartment 202 and the rear compartment 204 may be partially defined by the dividing panel 106. In this regard, the dividing panel 106 may divide an internal space of the package 200 into two compartments 202, 204, with the dividing panel separating the front compartment 202 from the rear compartment 204.

Thus, the package 200 may include a plurality of panels, a rear compartment 204 defined by four of the panels, and a front compartment 202 defined by four of the panels. The rear compartment 204 and the front compartment 202 may be arranged in a back-to-back configuration, (as illustrated, e.g., in FIG. 5), and two of the panels of the rear compartment may be common to two of the panels of the front compartment. In the illustrated embodiment, the first side panel 108 and dividing panel 106 are common to both the front compartment 202 and the rear compartment 204.

Figure 6:
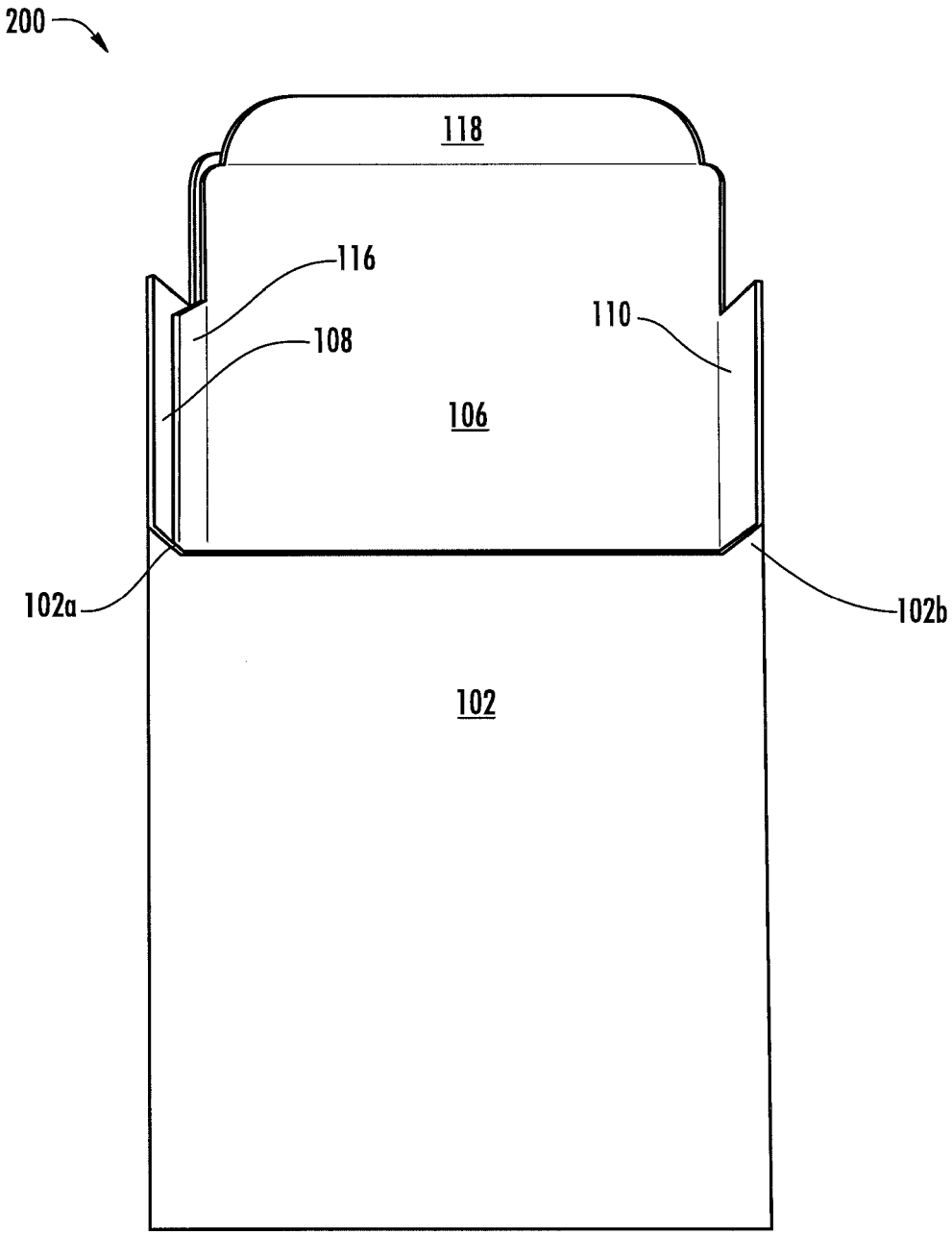
FIG. 6 is a front view of the multi-compartment package of FIG. 4.
Figure 7:
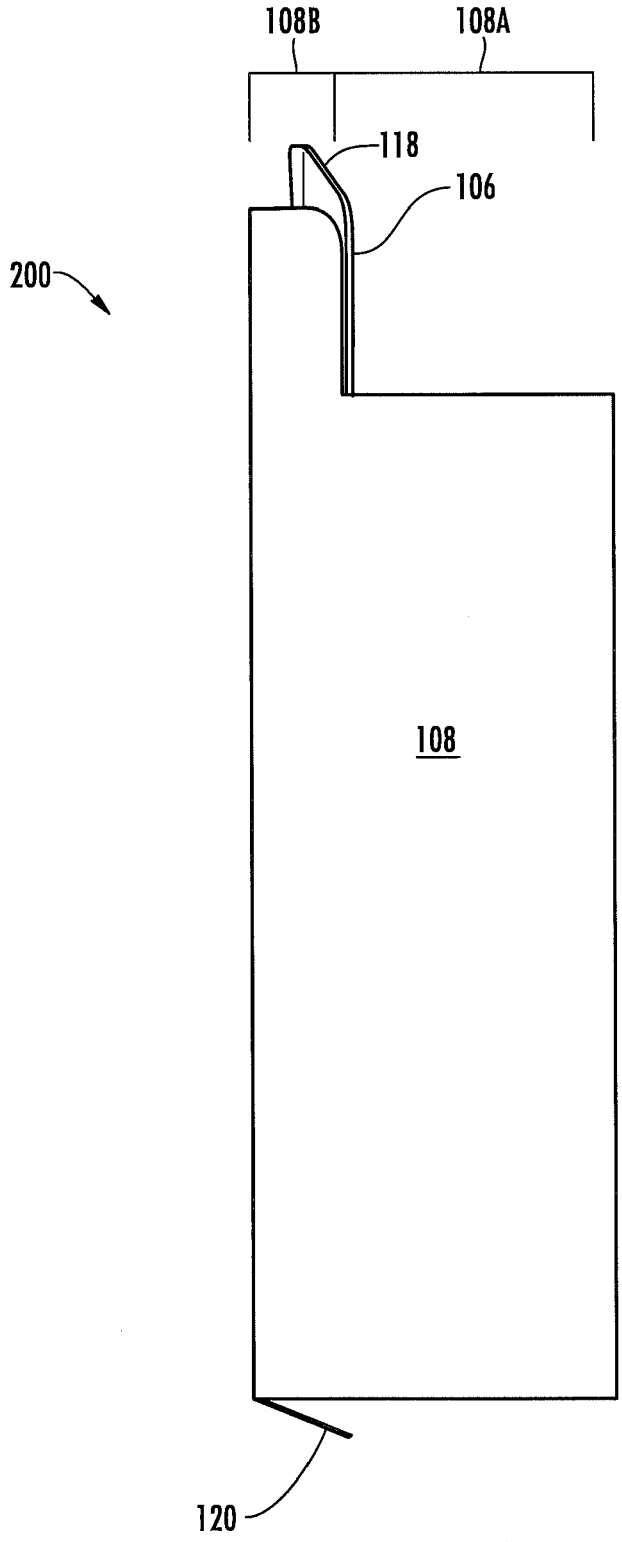
FIG. 7 is a side view of the multi-compartment package of FIG. 4 illustrating a first side panel.
Figure 8:
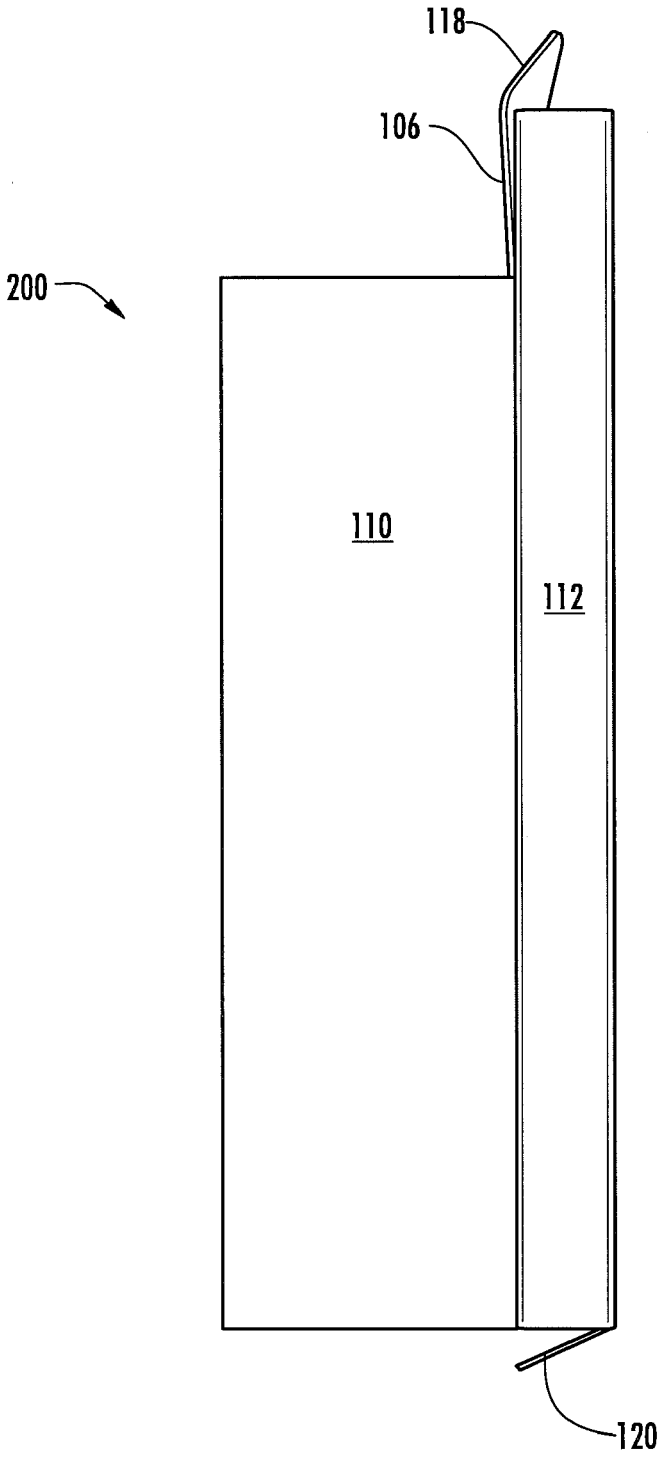
FIG. 8 is a side view of the multi-compartment package of FIG. 4 illustrating a second side panel and a rear side panel.
Figure 9:
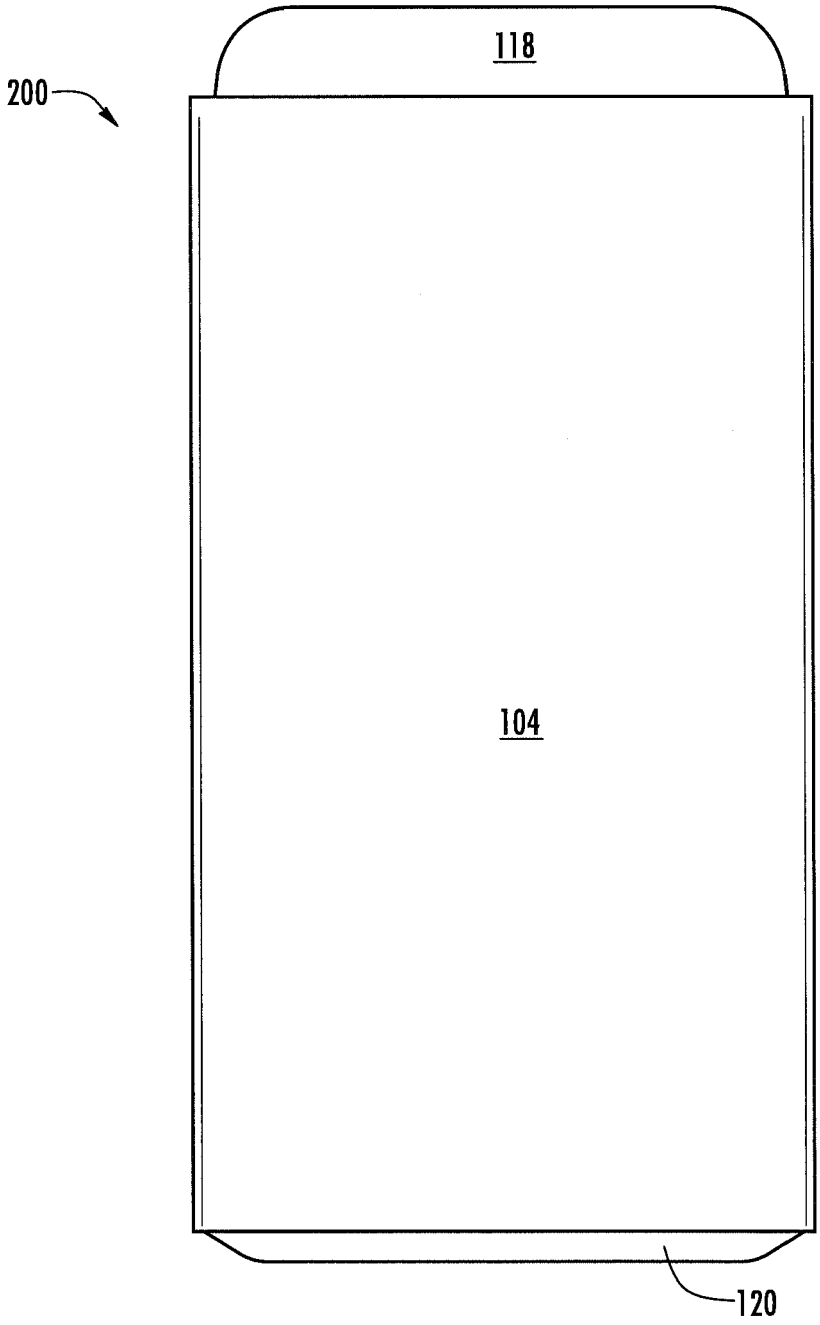
FIG. 9 is a rear view of the multi-compartment package FIG. 4.
Figure 10:
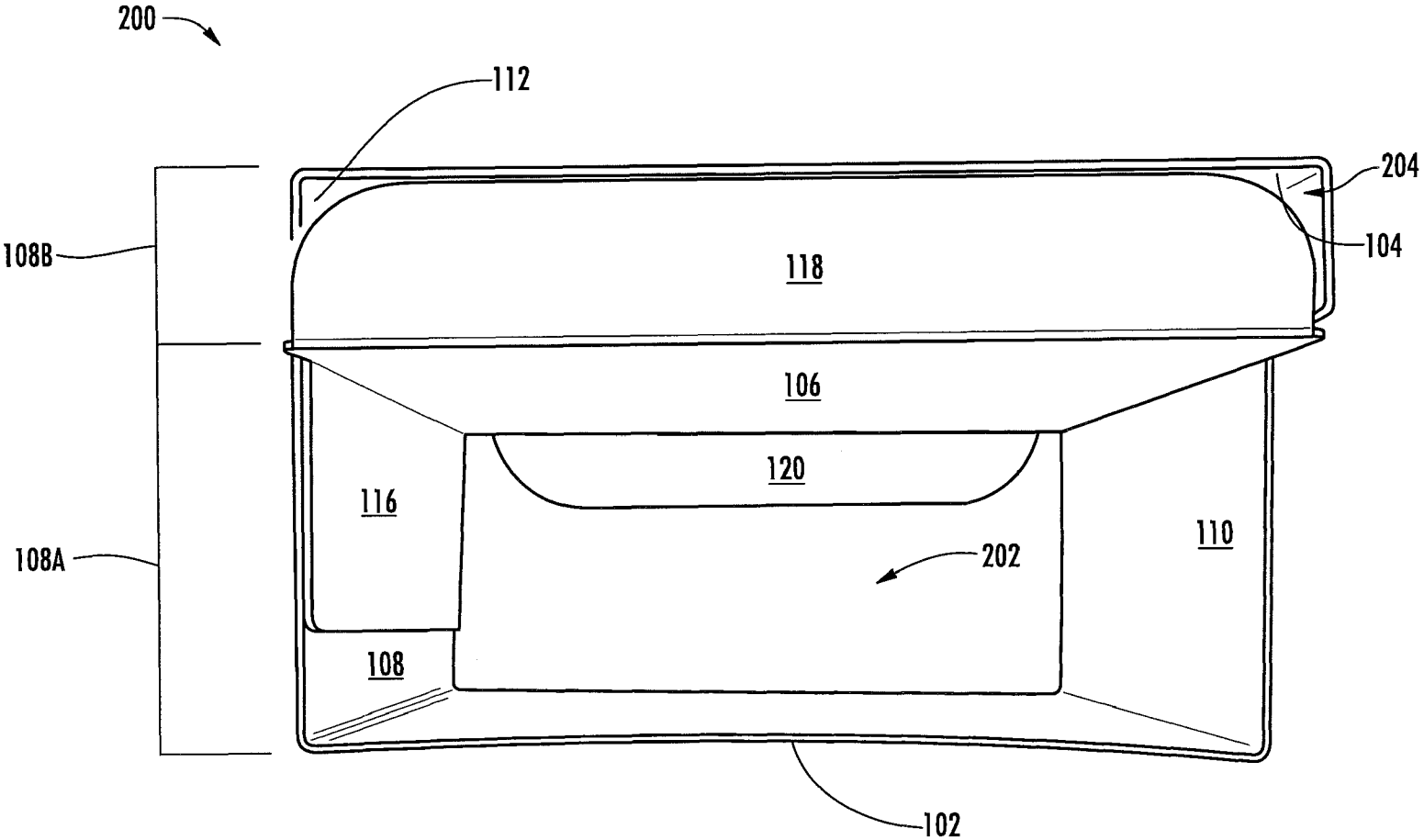
FIG. 10 is a top view of the multi-compartment package of FIG. 4.
Figure 11:
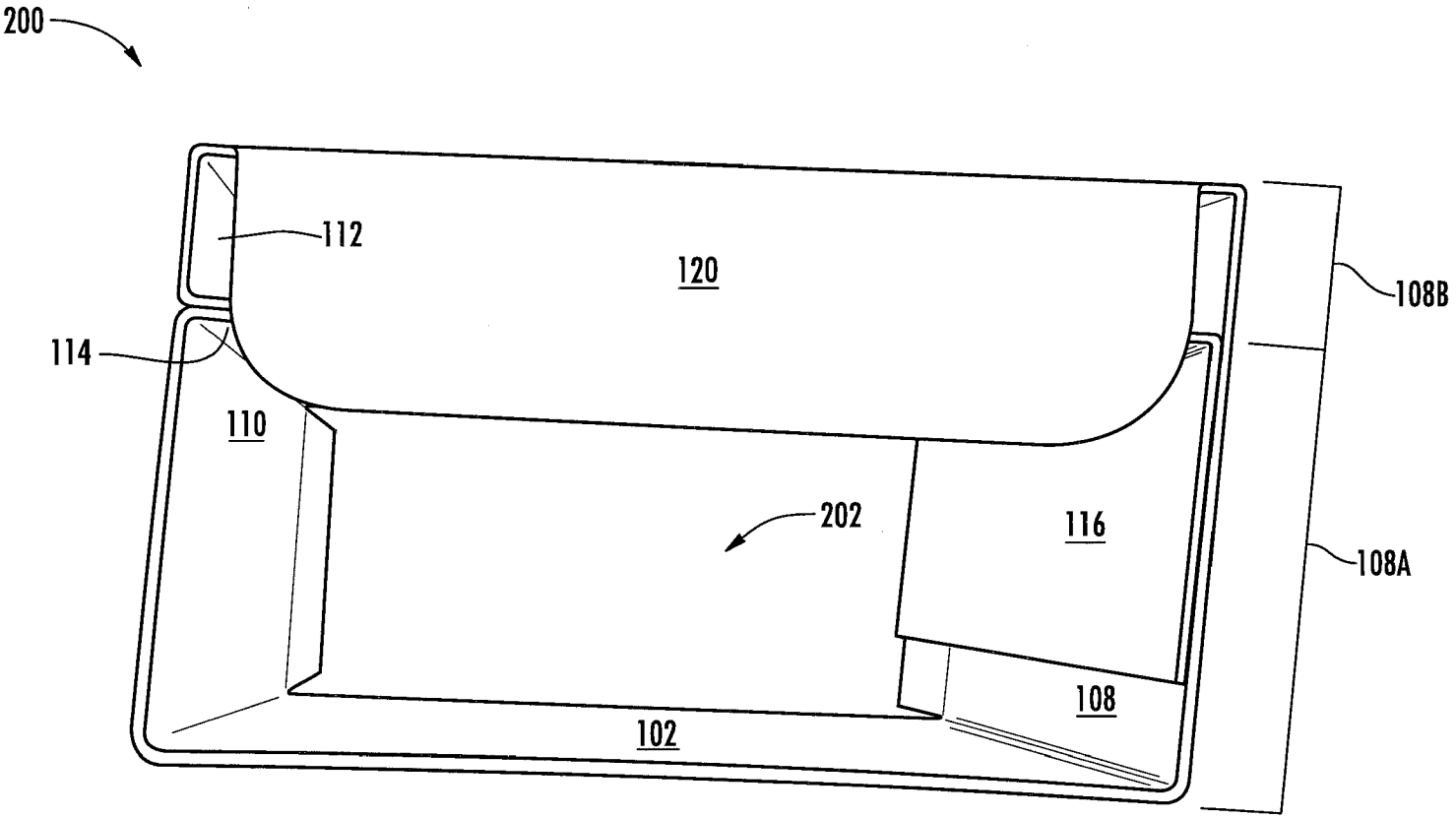
FIG. 11 is a bottom view of the multi-compartment package of FIG. 4.

Additional views of the package 200 are provided in FIGS. 6-11. In particular, FIG. 6 illustrates a front view of the package 200. FIG. 7 illustrates a side view of the package 200 at the side defined by the first side panel 108. FIG. 8 illustrates an opposing side view of the package 200, at a side which is defined by the second side panel 110 in combination with the rear side panel 112. Further, FIG. 9 is a rear view of the package 200, FIG. 10 is a top view of the package, and FIG. 11 is a bottom view of the package.

Figure 12:
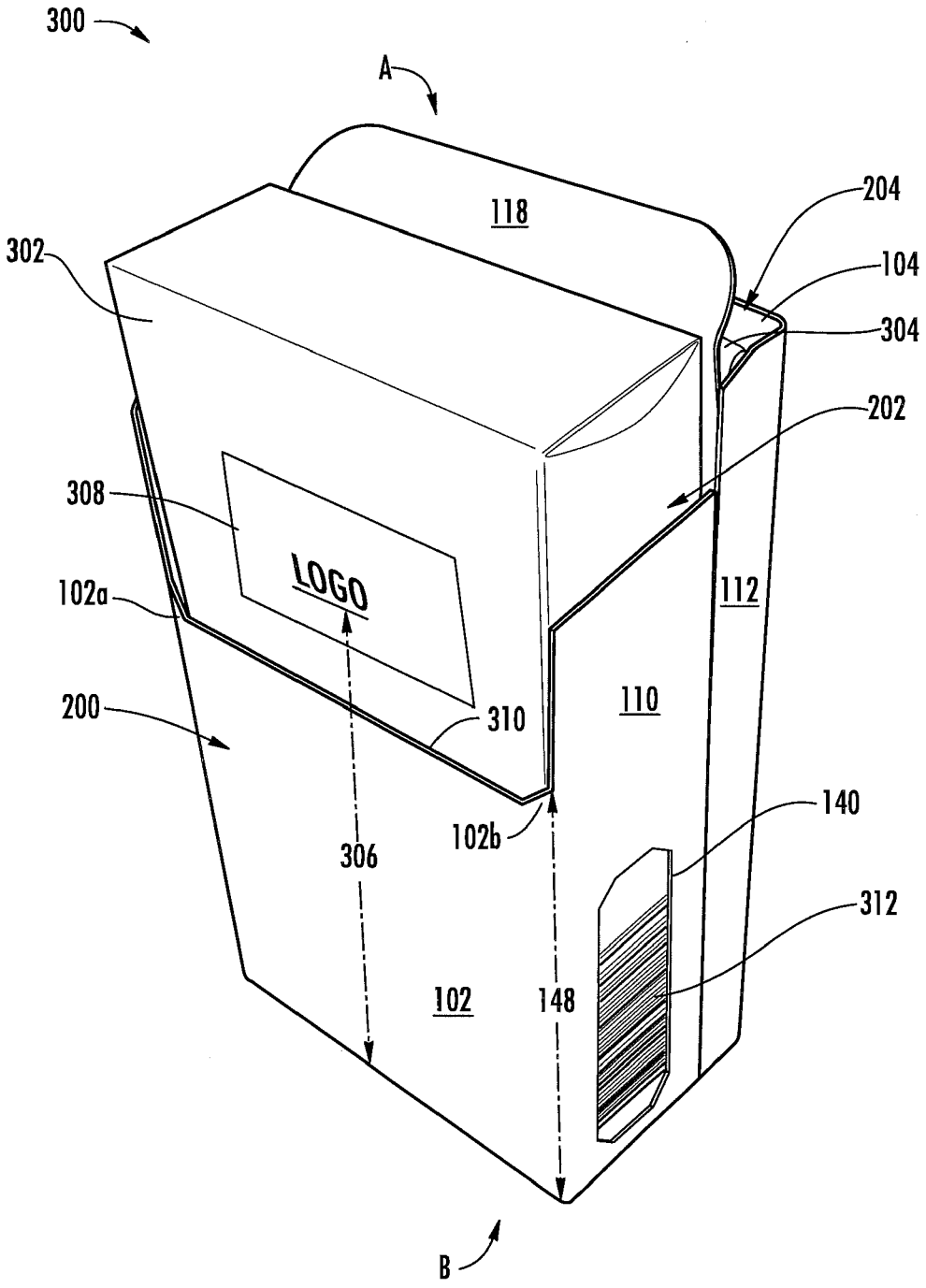
FIG. 12 is a front perspective view of an assembly comprising an embodiment of the multi-compartment package of FIG. 4 with an aperture in a side panel.
Figure 13:
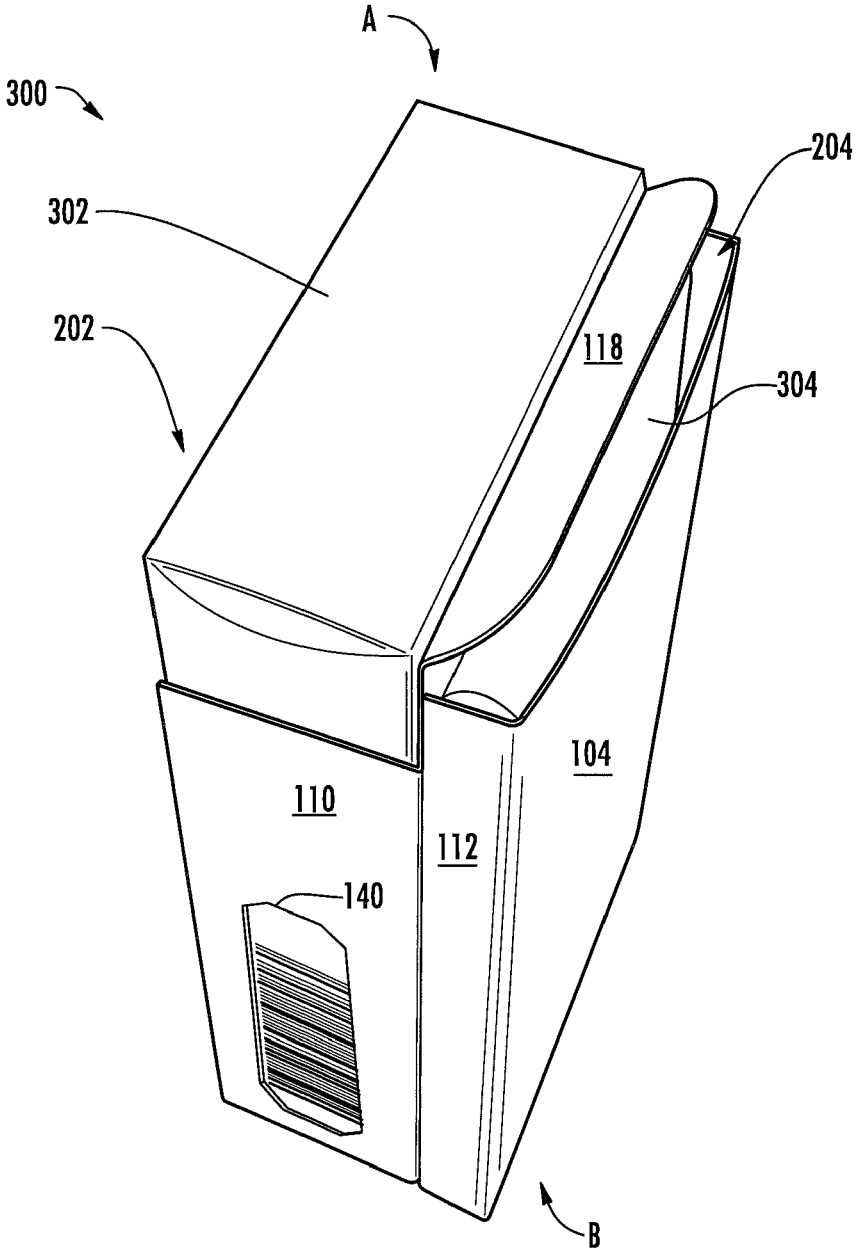
FIG. 13 is a rear perspective view of the assembly of FIG. 12.

The front compartment 202 and/or the rear compartment 204 may be configured to store one or more items. In this regard, FIGS. 12 and 13 illustrate an assembly 300 in accordance with an example embodiment. The assembly 300 may comprise the package 200, a first item 302 received in the front compartment 202 of the package, and a second item 304 received in the rear compartment 204 of the package. The assembly 300 may be formed by inserting the first item 302 into the front compartment 202 and inserting the second item 304 into the rear compartment 204.

As illustrated in the front perspective view of FIG. 12, the first item 302 may comprise a cigarette pack in some embodiments. As further illustrated in FIG. 12, the height 148 of the front panel 102 (inclusive or exclusive of the corner features 102*a*, 102*b*) may be less than the height 306 of a logo 308 (or other information or identifier) on the first item 302. In this regard, the logo 308 on the first item 302 (e.g., the cigarette pack illustrated in FIGS. 12 and 13) may be positioned above a top 310 of the front panel 102 to thereby allow a user to view the logo. Accordingly, information with respect to the first item 302 may be visible without first requiring removal of the first item from the front compartment 202. In an alternate embodiment, the front panel may define an aperture configured to align with the logo (or other information or identifier) such that the logo on the first item is visible.

As further illustrated in FIG. 12, the package 200 may include an aperture 140 defined in the second side panel 110 of the package 200. The aperture 140 may be configured to align with an identifier 312 on the first item 302. Accordingly, the identifier 312 may be visible when the first item 302 is received in the front compartment 202 of the package 200. In some embodiments the identifier may comprise a universal product code ("UPC") or a statutorily mandated warning label, although various other identifiers, logos, or other information may be included on the first item and aligned with the aperture in other embodiments.

As illustrated in FIG. 13, the second item 304 may be received in the rear compartment 204. The second item 304 may comprise one or more smokeless tobacco packages in some embodiments. For example, in one embodiment the second item 304 may comprise one or more packages of snuff or snus. In one embodiment the second item 304 may comprise a zippered pouch. However, the second item may comprise various other products in other embodiments.

As noted above, the package 200 may include a tab 118 connected to the dividing panel 106 and/or a tab 120 connected to the rear panel 104. As further noted above, the tab 118 connected to the dividing panel and the tab 120 connected to the rear panel 104 may be positioned on opposing sides A, B of the blank 100, and hence on opposing sides A, B of the package 200 and the assembly 300. In order to at least partially retain the second item 304 in the rear compartment 204, a method for forming the assembly 300 may include folding the tab 118 connected to the dividing panel 106 toward the rear panel 104 and folding the tab 120 connected to the rear panel toward the dividing panel. Accordingly, the rear compartment 204 may be at least partially closed at the first side A by the tab 118 connected to the dividing panel 106 and closed at the opposing second side B by the tab 120 connected to the rear panel 104.

In order to secure the first item 302 in the front compartment 202 and/or the second item 304 in the rear compartment 204, the assembly 300 may further comprise a wrapper that extends partially or fully about the package 200. For example, a clear plastic wrapper may extend partially or completely around the package 200. Exemplary films that may be utilized according to the invention include polypropylene materials, cellulose base films, PLA films, and like films formed from biomaterials.

In some embodiments adhesive (e.g., glue) may be employed to releasably adhere the first item 302 in the front compartment 202 and/or releasably adhere the second item 304 in the rear compartment 204. For example, adhesive may be applied to one or more of the dividing panel 106, the first side panel 108 (specifically, an inside surface of the front portion 108A of the first side panel), the second side panel 110, and the front panel 102) in order to retain the first item 302 in the front compartment 202. Releasable adhesive may be alternatively or additionally applied to the first item 302. Accordingly, the first item 302 may be retained in the front compartment 202.

Similarly, releasable adhesive may be applied to one or more of the dividing panel 106, the rear side panel 112, the first side panel 108 (specifically, an inside surface of the rear portion 108B of the first side panel), and the rear panel 104 in order to retain the second item 304 in the rear compartment 204. Releasable adhesive may be alternatively or additionally applied to the second item 304. Alternatively, or additionally, the tab 118 connected to the dividing panel 106 may be adhered to rear panel 104 and/or the tab 120 connected to the rear panel may be adhered to the dividing panel. In this regard, the second item 304 may be substantially enclosed in the rear compartment 204 in some embodiments. Thus, the second item 304 may be retained in the rear compartment 204. Exemplary adhesives that may be used include those already described herein.

Embodiments of the blank 100, package 200, and assembly 300 may be used for a variety of purposes. By way of example, the assembly 300 may be employed for providing a configuration of two products, such as two packages of tobacco items, optionally provided in different quantities or different product sizes. For example, the first item 302 may be a typically sized package of cigarettes (e.g., containing about 20 cigarettes), and the second item 304 may be one or more packages of a smokeless tobacco product, which optionally may be provided in a quantity that is less than a typical commercial amount of the smokeless tobacco product. Thus, both products may be purchased together by a consumer. In other embodiments, the blank 100, package 200, and assembly 300 may be employed for a variety of other purposes where first and rear compartments may be desirable.

In one example, an assembly as described herein may be used to provide a combination of differently sized packages of tobacco products. Specifically, in the front compartment, the assembly can include a so-call hard pack of cigarettes, such package having a height of about 80 to 90 mm (e.g., about 85 mm), a width of about 50 to 60 mm (e.g., about 55 mm), and a depth of about 20 to 25 mm (e.g., about 23 mm). In the rear compartment, the assembly can include a package of a smokeless tobacco product, such package having a height of about 95 to about 105 mm (e.g., about 100 mm), a width of about 50 to about 60 mm (e.g., about 55 mm), and a depth of about 5 to about 10 mm (e.g., about 8 mm) In such combinations of product packages, the package of smokeless tobacco may be referred to as a shallow pack. Thus, the foregoing exemplifies embodiments wherein the package in the front compartment can have a height that is less than the height of the package in the rear compartment. In other embodiments, the package in the front compartment can have a height that is substantially similar to the height of the package in the rear compartment (for example, both packages having a height of about 95 to about 105 mm—e.g., about 100 mm). Furthermore, the package in the front compartment may have a height that is greater than the height of the package in the rear compartment.

As seen above, the combination packages described herein particularly can be useful for providing packages of two types of tobacco products. In various embodiments, the materials used in making the packages stored in the front and rear compartments of the assembly can vary. For example, as noted above, the package 200 may be configured to receive a cigarette package in one of the compartments 202, 204. The cigarette package may be formed from a paperboard blank along with conventional package insert materials such as a paper/foil laminate. Further, an over wrap may be wrapped about the cigarette package, which may comprise cellophane, polypropylene, or a metalized material in some embodiments. Additional description with respect to example cigarette packages that may be included with the package 200 is provided in U.S. Pat. No. 5,139,140 to Burrows et al. The other of the compartments 202, 204 may be configured to receive a package of a smokeless tobacco product. Smokeless tobacco products can include, for example, those packaged in metal packaging, plastic packaging, metal/plastic combination packaging, film packaging, paper pouch packaging, and the like.

Although directional terms such as top, bottom, front, back, etc. have been employed herein, it should be understood that these terms have been provided for explanatory purposes only. In this regard, the blank, package, and assembly disclosed herein may be employed in other configurations and orientations beyond those described above. Accordingly, by way of example, the disclosure provided herein is intended to include side-by-side configurations, stacked configurations, or various other configurations of two compartments formed by a package.

Many modifications and other embodiments of the disclosure will come to mind to one skilled in the art to which this disclosure pertains having the benefit of the teachings presented in the foregoing description; and it will be apparent to those skilled in the art that variations and modifications of the present disclosure can be made without departing from the scope or spirit of the disclosure. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A blank configured to form a multi-compartment package, the blank comprising:

a rear panel;
a rear side panel connected to the rear panel;
a first side panel connected to the rear panel;
a front panel connected to the first side panel;
a second side panel connected to the front panel; and
a dividing panel connected to the second side panel,
wherein a width of the first side panel is greater than a width of the rear side panel,
wherein the first side panel defines a front portion that is connected to the front panel and a rear portion that is connected to the rear panel, and
wherein the front portion defines a height that is less than the rear portion.

2. The blank of claim 1, wherein a height of the front panel is less than a height of the first side panel and the second side panel.

3. The blank of claim 1, further comprising a first end panel connected to the rear side panel.

4. The blank of claim 3, further comprising a second end panel connected to the dividing panel.

5. The blank of claim 1, further comprising a tab connected to the dividing panel.

6. The blank of claim 5, further comprising a tab connected to the rear panel.

7. The blank of claim 6, wherein the tab connected to the dividing panel and the tab connected to the rear panel are positioned at opposing sides.

8. The blank of claim 1, further comprising an aperture defined in the second side panel.

9. The blank of claim 1, wherein a width of the first side panel is greater than a width of the second side panel.

10. The blank of claim 9, wherein the width of the first side panel is substantially equal to the width of the second side panel and the width of the rear side panel combined.

11. A multi-compartment package, comprising:
a rear panel;
a rear side panel connected to the rear panel;
a first end panel connected to the rear side panel;
a first side panel connected to the rear panel;
a front panel connected to the first side panel;
a second side panel connected to the front panel;
a dividing panel connected to the second side panel; and
a second end panel connected to the dividing panel,
wherein the first end panel is coupled to the dividing panel to define a rear compartment between the dividing panel, the rear side panel, the first side panel, and the rear panel,
wherein the second end panel is coupled to the first side panel to define a front compartment between the dividing panel, the first side panel, the second side panel, and the front panel,
wherein the first side panel defines a front portion that is connected to the front panel and a rear portion that is connected to the rear panel, and
wherein a height of the front portion is less than a height of the rear portion.

12. The multi-compartment package of claim 11, wherein a width of the first side panel is greater than a width of the rear side panel.

13. The multi-compartment package of claim 11, wherein a height of the front panel is less than a height of the first side panel and the second side panel.

14. The multi-compartment package of claim 11, further comprising a tab connected to the dividing panel.

15. The multi-compartment package of claim 14, further comprising a tab connected to the rear panel.

16. The multi-compartment package of claim 15, wherein the tab connected to the dividing panel and the tab connected to the rear panel are positioned at opposing sides.

17. The multi-compartment package of claim 11, further comprising an aperture defined in the second side panel.

18. The multi-compartment package of claim 11, wherein a width of the first side panel is greater than a width of the second side panel.

19. The multi-compartment package of claim 18, wherein the width of the first side panel is substantially equal to the width of the second side panel and a width of the rear side panel combined.

20. An assembly, comprising:
a rear panel;
a rear side panel connected to the rear panel;
a first end panel connected to the rear side panel;
a first side panel connected to the rear panel;
a front panel connected to the first side panel;
a second side panel connected to the front panel;
a dividing panel connected to the second side panel;
a second end panel connected to the dividing panel;
a cigarette pack; and
a second item,
wherein the first end panel is coupled to the dividing panel to define a rear compartment between the dividing panel, the rear side panel, the first side panel, and the rear panel, the second item being received in the rear compartment, and
wherein the second end panel is coupled to the first side panel to define a front compartment between the dividing panel, the first side panel, the second side panel, and the front panel, the cigarette pack being received in the front compartment.

21. The assembly of claim 20, wherein a width of the first side panel is greater than a width of the rear side panel.

22. The assembly of claim 20, wherein a height of the front panel is less than a height of the first side panel and the second side panel, and
wherein a logo on the cigarette pack is positioned above a top of the front panel.

23. The assembly of claim 20, further comprising an aperture defined in the second side panel,
wherein an identifier on the cigarette pack is aligned with the aperture in the second side panel.

24. The assembly of claim 20, wherein the second item comprises a smokeless tobacco package.

25. The assembly of claim 24, wherein the multi-compartment package further comprises a tab connected to the dividing panel and a tab connected to the rear panel,
wherein the tab connected to the dividing panel and the tab connected to the rear panel are positioned at opposing sides, and
wherein the tab connected to the dividing panel is folded toward the rear panel and the tab connected to the rear panel is folded toward the dividing panel to at least partially retain the smokeless tobacco package in the rear compartment.

26. A method for forming a multi-compartment package, the method comprising:
providing a blank, comprising:
a rear panel;
a rear side panel connected to the rear panel;
a first end panel connected to the rear side panel;
a first side panel connected to the rear panel;
a front panel connected to the first side panel;
a second side panel connected to the front panel;
a dividing panel connected to the second side panel; and a second end panel connected to the dividing panel;

coupling the first end panel to the dividing panel to define a rear compartment between the dividing panel, the rear side panel, the first side panel, and the rear panel;

coupling the second end panel to the first side panel to define a front compartment between the dividing panel, the first side panel, the second side panel, and the front panel;

inserting a cigarette pack into the front compartment; and inserting a second item into the rear compartment.

27. The method of claim 26, wherein the blank further comprises a tab connected to the dividing panel and a tab connected to the rear panel, wherein the tab connected to the dividing panel and the tab connected to the rear panel are positioned at opposing sides; and wherein the method further comprises folding the tab connected to the dividing panel toward the rear panel and folding the tab connected to the rear panel toward the dividing panel to at least partially retain the second item in the rear compartment.

* * * * *